US005351533A

United States Patent [19]

Macadam et al.

[11] Patent Number: 5,351,533

[45] Date of Patent: Oct. 4, 1994

[54] COILED TUBING SYSTEM USED FOR THE EVALUATION OF STIMULATION CANDIDATE WELLS

[75] Inventors: James M. Macadam; Donald E. Bailey; Ronald E. Savage, all of Duncan, Okla.

[73] Assignee: Halliburton Company, Duncan, Okla.

[21] Appl. No.: 84,678

[22] Filed: Jun. 29, 1993

[51] Int. Cl.[5] ..... E21B 47/06; E21B 47/00

[52] U.S. Cl. ..... 73/155; 166/316; 166/71; 166/77; 73/151

[58] Field of Search ..... 73/155, 151; 166/71, 166/166.77, 316

[56] References Cited

U.S. PATENT DOCUMENTS

| | | | |
|---|---|---|---|
| 1,924,425 | 8/1933 | Wickersham et al. | 166/71 |
| 4,621,403 | 11/1986 | Babb et al. | 166/77 |
| 4,763,520 | 8/1988 | Titchener et al. | 73/155 |
| 4,844,166 | 7/1989 | Going, III et al. | 166/77 |
| 4,852,401 | 8/1989 | Hrametz et al. | 73/155 |
| 4,938,060 | 7/1990 | Sizer et al. | 73/151 |
| 4,940,095 | 7/1990 | Newman | 166/77 |

FOREIGN PATENT DOCUMENTS

| | | | |
|---|---|---|---|
| WO93/01391 | 1/1993 | PCT Int'l Appl. | 49/10 |

OTHER PUBLICATIONS

G. W. Haws, B. L. Knight, "State-of-the-Art Simultaneous Downhole Flow-Rate and Pressure Measurement Equipment," SPE Production Engineering, Nov. 1991.

*Primary Examiner*—Hezron E. Williams
*Assistant Examiner*—J. David Wiggins
*Attorney, Agent, or Firm*—James R. Duzan; Stephen R. Christian; Keith Rutherford

[57] ABSTRACT

The present invention is an improved apparatus and method for measuring downhole flowing and shut-in pressures to determine the condition of the reservoir and the potential of the well as a stimulation candidate. The tool string of the present invention is a novel combination of existing equipment that allows an electronic pressure gauge and shut-in tool to be run into the hole with coiled tubing. The present invention, in most cases, solves the potential problem of having to shut in or kill a flowing well prior to and after performing pressure testing, preventing lost production or potential well damage due to the killing operation. In addition, the present invention provides accuracy over current coiled tubing systems by reducing the effects of wellbore storage on pressure build-up testing.

15 Claims, 3 Drawing Sheets

COILED TUBING SYSTEM USED FOR THE EVALUATION OF STIMULATION CANDIDATE WELLS

BACKGROUND OF THE INVENTION

The present invention is directed to an apparatus and method for use in downhole pressure information gathering to determine condition of the reservoir and potential of a given well as a stimulation candidate.

Historically, because of the high cost of stimulation treatments, it has been, and continues to be, critical to select proper candidate wells on which to perform stimulation treatments. Three important pieces of data used in determining if a well is a candidate for a stimulation treatment are (1) the extent of the reservoir, i.e., how much oil is in place accessible from the well bore; (2) the existence of damage in the near well bore region; and (3) measurement of portability. If the well bore has penetrated only a very small reservoir, the total recovery that may be had from that reservoir may not be enough to justify the cost of an expensive stimulation treatment. Further, if there is no near well bore damage or extremely tight permeability, a stimulation treatment may be ineffective in increasing production to an economical production. One other important consideration before determining if a well is a candidate for a stimulation treatment is to determine if the well is in good mechanical condition. This is important for three reasons: (1) to ensure that the well will last long enough to take advantage of the increased production; (2) to ensure that the stimulation treatment will go where it is intended to go; and (3) to ensure that no damage or danger will occur below ground level.

The present invention offers an improved apparatus and method for measuring downhole flowing and shut-in pressures, as well as for performing mechanical integrity analysis. The same type of analysis has been done in the past, but with much less efficiency and at a higher expense and risk to production.

In the past, in flowing wells, pressure analysis has been performed by using a wireline-conveyed, downhole pressure gauge, in conjunction with a wireline-conveyed shut-in tool to control fluid flow. The first initial problem with such a system is that with the use of wireline, a lubricator stack tall enough to receive the entire tool string is required to ensure proper well control at all times. In addition, with a shut-in pressure analysis, it is important for accurate test results that the well be shut-in at a time when the well has reached a stable flow.

In a flowing well, particularly a gas well, high pressures and high flow rates may make it virtually impossible to get a wireline tool down the tubing string without first having to kill the well. Once the well is killed, only then can the operator run in the hole with a wireline shut-in tool and pressure gauge. Once the downhole tool is seated in a landing nipple below the packer, the kill fluid can be circulated out and the downhole shut-in valve can be opened to allow free flow of the fluids into the well bore. Once flow is started again, it will require some period of time to get back to a stable flow region, generally at least 72 hours, but for truly accurate results it should be the amount of time that the well had flowed prior to shut-in. At that point in time, the shut-in valve is closed and the pressure build-up test is begun.

After the pressure build-up test, it will once again generally be necessary to circulate kill fluid into the hole for well control while the shut-in wireline tool is removed. After the wireline tool is removed, the kill fluid can be circulated out of the hole and the well can then be put back on production.

The obvious problems with past wireline systems are that the operator will be losing production any time the well is shut-down or killed. In addition, particularly in a gas well, there is always a risk that once a well is killed it may not be able to kick off or re-start production again. Therefore, an improved apparatus and method are needed to perform downhole testing while requiring less down-time of the well, less risk of production stoppage due to killing the well, and quicker and easier operations.

While pressure gauges have been run in the past using coiled tubing with wireline inside, those applications have generally been in horizontal wells or wells with doglegs. In horizontal or doglegged wells, the rigidity of the coiled tubing may be necessary to push the logging tool to the desired depth or location. However, such a system has not been used in conjunction with a downhole shut-in valve such that the effects of wellbore storage on the pressure build-up test can be greatly reduced. Also, the use of coiled tubing systems in horizontal wells in the past has generally been at static conditions, i.e., with the hole full of mud or water, not during flowing conditions as under the present invention.

In addition, no mechanical integrity testing can be performed without a downhole shut-in tool. As a result, use of a coiled tubing system without a downhole shut-in tool will still require that once the build-up work is complete, a wireline downhole shut-in tool be run in the hole to test the mechanical integrity of the tubing and/or casing string. At that point, the same problems will be encountered with high pressure/high flow rate wells in that the well may have to be killed just to get the shut-in tool in the hole to perform the mechanical integrity test. While killing the well after the pressure testing is complete eliminates some of the inherent problems of wireline testing, the risk of the well not returning to full production still exists anytime a well is killed.

SUMMARY OF INVENTION

The present invention is an improved apparatus and method for gathering pressure and temperature information from wells. The present invention includes a novel combination of presently existing tools, one of which is modified under a preferred embodiment disclosed herein.

The present apparatus includes the use of coiled tubing with electrical wireline inside, as is known to the art. Such coiled tubing is provided by Halliburton Services of Duncan, Okla. A conventional coiled tubing end connector is used to connect the coiled tubing to the tool string and to pack off the wireline. Attached below the coiled tubing end connector is a conventional pressure data converting unit containing a microprocessor or the like used to convert the pressure data from the pressure gauge to data readable by surface equipment. A pressure data converting unit is contained in a Halliburton Memory Recording Tool. Next, in a preferred embodiment using a multiple-wire wireline (a further preferred embodiment utilizes a five-wire wireline), another gauge or set of gauges may be installed, such as a collar locator. Below either the microprocessor unit or other gauge is a pressure gauge controller. A pressure gauge controller is also contained in a Halliburton Memory Recording Tool. Directly below the pressure gauge controller is an electronic pressure gauge, examples of which are described in U.S. Pat. Nos. 4,936,147 and 4,866,607, or is contained in a Halliburton Memory Recording Tool. Connected to the electronic pressure gauge is a shut-in tool that seats in a nipple, preferably below the packer. One such shut-in tool is a Halliburton Reservoir Services Model "A" shut-in tool. The shut-in tool should pack off between the tool string and the tubing string and provide the ability to either shut off flow, or allow flow of fluid through the tool.

The present invention can also be used to perform injectivity testing. However, the shut-in tool will need to be unseated before fluid may be pumped down the tubing string.

In a preferred embodiment, the present invention utilizes a multiple-wire wireline and multiple data collection tools to gather more information with the single run. Even without additional data collection tools, the use of a multiple-wire wireline will allow for more complete and continuous pressure data gathering.

In a further preferred embodiment, a spinner or flow rate measuring unit to measure fluid flow can be placed in the tool string to allow measurement of reservoir influx during the pressure build up test. The use of the spinner will allow for additional accuracy by providing a means for calculating the change of flow rate as the minimal wellbore storage is filling. This change of rate with the change of pressure can greatly enhance the results of, and diminish the time required for, the analysis.

To use a spinner or flow rate meter the shut-in tool discussed above is modified to allow for an electrical connection from the spinner below the shut-in valve to the wireline above. For this modification a hole is made through the body of the shut-in tool which surrounds the valve means. The flow rate meter is then connected to the bottom of the shut-in tool. As will also be apparent to those skilled in the art, a spinner could be installed in the shut-in tool itself below the actual valve means. The electrical cable is then run up through the hole in the shut-in tool, and is pressure sealed into the hole in the shut-in tool by any of the methods common in the art. An electrical connection is then provided at the top of the shut-in tool which can be used to connect the flow rate meter below to the wireline when the tool string of the present invention is assembled.

The present invention, through its use of coiled tubing, eliminates the need for killing or shutting-in a flowing well prior to running in with the tool string. Therefore, the pressure testing with the present invention can be performed immediately after the tool string is run in the hole because the tool string is run into the hole during stabilized flow. Using a sequence of flowing, shut-in, draw-down, injectivity, and mechanical integrity testing the present invention can provide a full range of necessary data from the well with the well being shut in only for the time necessary to perform the well tests. The present invention provides increased accuracy for pressure build-up testing by eliminating the majority of the wellbore storage effect by placing a shut-in tool at or below the packer. Also, mechanical integrity testing may be performed during the same tool run without the need for killing the well; in contrast to the need for a second tool run with past coiled tubing pressure testing applications.

The ability of the present invention using one tool string to perform a full range of accurate testing while causing no unnecessary expense and risk of killing or shutting-in the well provides a cost, expense, and time advantage over the prior art.

DETAILED DESCRIPTION OF PREFERRED EMBODIMENTS

Figure 1:
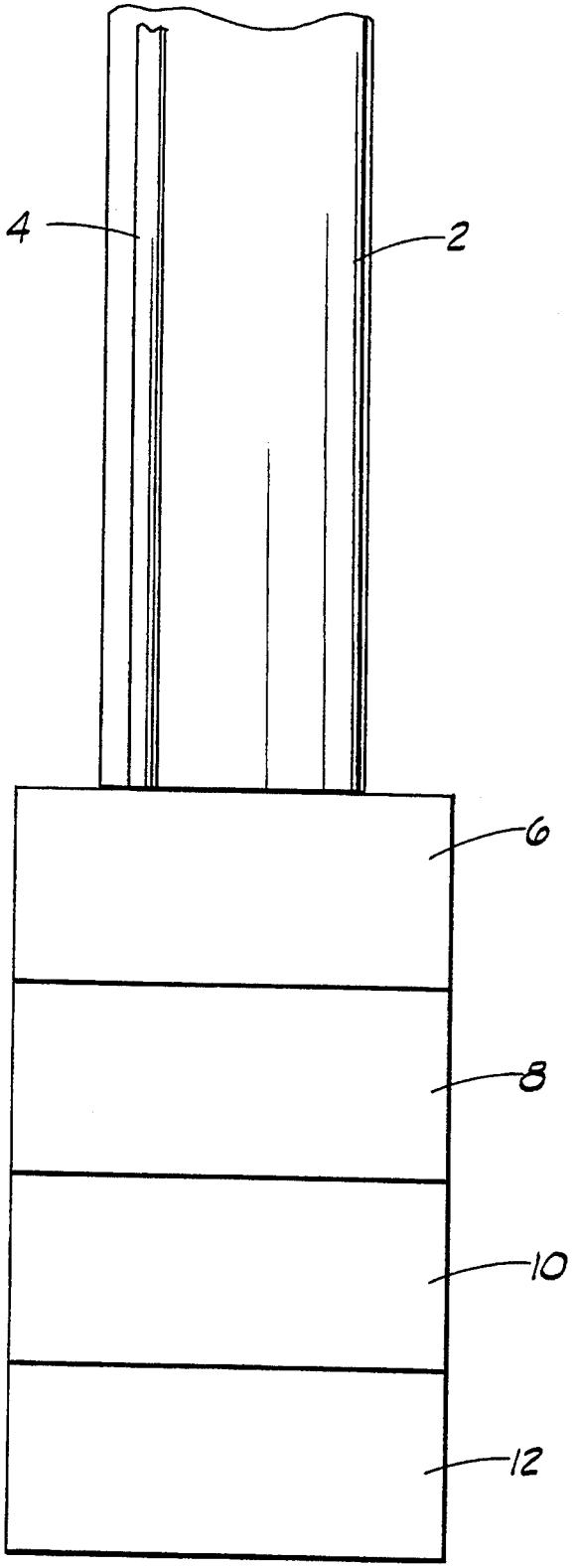
FIG. 1 is a schematic representation of an exemplary tool string in accordance with the present invention.

FIG. 1 schematically shows a conventional coiled tubing string 2 with electric wireline 4 inside. Coiled tubing with electric wireline inside is described, for example, in Halliburton Logging Services catalog entitled "Reeled-Tubing-Conveyed Wireline System." The wireline 4 can be monoconductor or, in a preferred embodiment, can be multiple-wire wireline.

Attached to the coiled tubing 2 is a conventional coiled tubing end connector 6, such as a Halliburton Logging Services wireline/coiled tubing connector, described in Halliburton Logging Service's catalog entitled "Reeled-Tubing-Conveyed Wireline System." In the present invention the wireline 4 is used solely to transmit data and not to carry weight. In one preferred embodiment, wireline/coiled tubing connector 6 crimps around the coiled tubing 2 and screws onto the top of the tool string.

Attached to the bottom of the coiled tubing connector 6 is a pressure data converting unit 8 used for converting pressure gauge information into data that will be sent up the wireline 4 and compiled at the surface. Pressure data converting unit 8 may be one such as a Halliburton Memory Recording Tool which is used to gather real time pressure and temperature data. One such memory recording tool is the QR2 Memory Recorder described in a Halliburton Reservoir Services Data sheet. However, other commercially available tools also provide the necessary conversion from the electrical signals from the pressure gauge to signals readable by computers on the surface.

Used in conjunction with the pressure data converting unit is a conventional electronic pressure gauge 10. An exemplary pressure data converting unit is shown in U.S. Pat. Nos. 4,936,147 and 4,866,607, incorporated herein by reference, or as is offered in the Halliburton QR2 Memory Recorder.

Finally, a shut-in tool 12, such as the Halliburton Reservoir Services Model "A" shut-in tool, is used at the bottom of the tool string. (Described in Halliburton Reservoir Services "Cased Hole Tools Manual", pp. 143–144.) The shut-in tool 12 locks into the tubing string and then is used to control fluid flow from the reservoir. Many shut-in tools are available on the market. The shut-in tool merely provides the ability to shut off flow by pulling tension on the tool string, and the shut-in tool itself; and further to open flow by releasing tension on the tool string. To connect the bottom of the electronic pressure gauge to the top of the shut-in tool, the operator may need to fashion a cross-over tool that matches the two different sets of threads. The cross-over tool should provide fluid communication from the shut-in tool to the bottom of the electronic pressure gauge. The present invention allows for measurement of the fluid pressure for both shut-in and flowing conditions.

Figure 2:
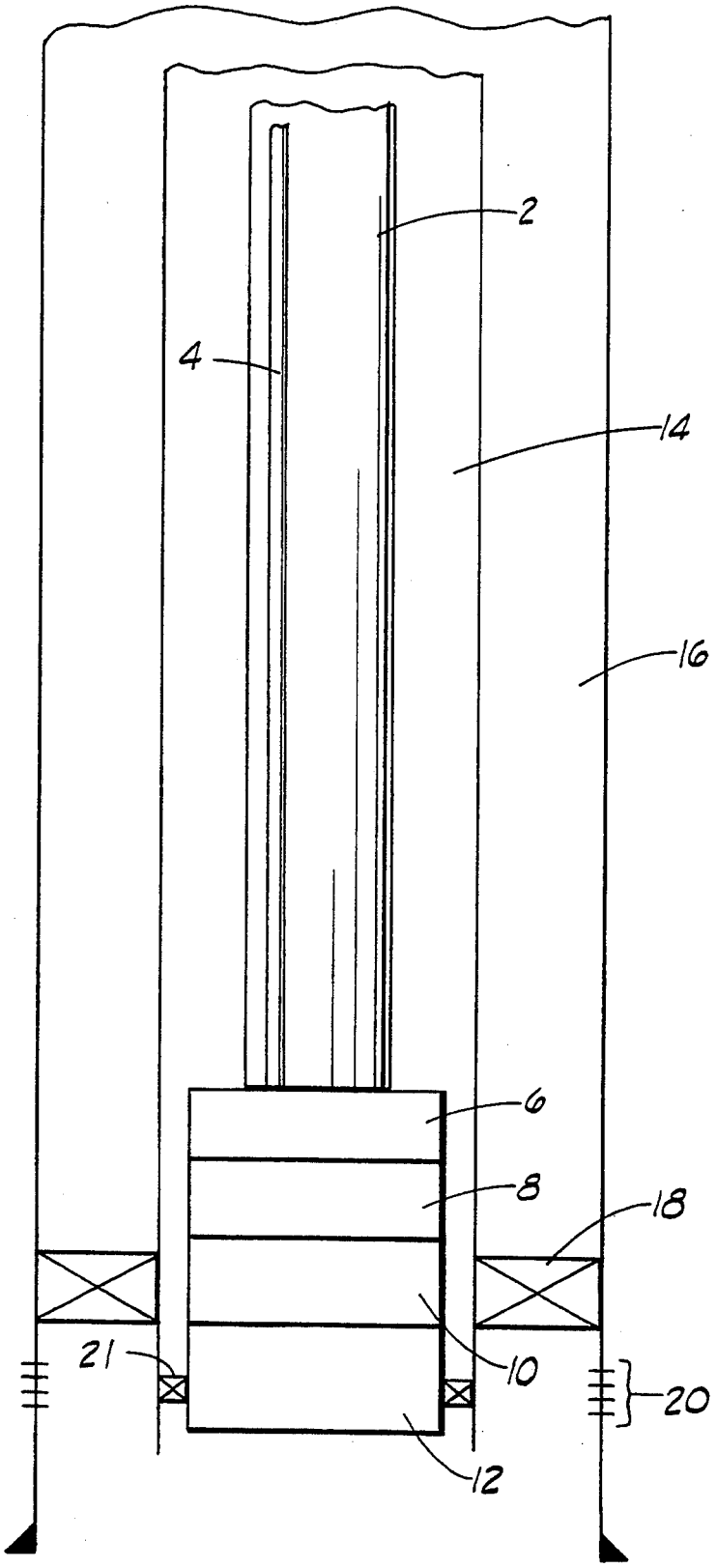
FIG. 2 is a schematic representation of an exemplary tool string in accordance with the present invention inside a tubing string.

FIG. 2 shows the present invention as it would be secured in the tubing string 14. The tubing 14 is held in the casing 16 by a packer 18 set above the perforations 20. The tool string of the present invention as depicted in FIG. 1 is locked into the tubing string 14 at a locking mandrel 21 placed, in a preferred embodiment, in the tubing string 14 below packer 18. The tool string attaches to the locking mandrel 21 at the shut-in tool 12.

To perform testing with the present invention as shown in FIG. 2, flow from the reservoir is controlled using the shut-in tool 12. Flowing pressures can be gathered when the tool string is first run in. The shut-in tool is then seated into an x-nipple below the packer. The shut-in tool is immediately opened by pulling up on the coiled tubing. Flowing pressure data is then collected. After sufficient flowing data is collected, the shut-in tool is shut by setting down weight on the coiled tubing string. A pressure build-up test is then performed. After sufficient pressure build-up data is gathered at the surface, the shut-in tool is opened and a pressure draw-down test may be performed. The well may be reopened for a draw-down test.

Once the draw-down test is complete, an injectivity test may be performed; after unseating the shut-in tool. Once the shut-in tool is unseated, fluid may be pumped down the tubing string. Another possible test would be to perform a mini frac test while measuring downhole pressure. Finally, prior to pulling the tool string of the present invention out of the hole, the shut-in valve is once again reseated and closed and pressure is then applied to the coiled tubing/tubing string or casing annulus. This mechanical integrity test will determine if any leaks exist in the annulus. The tool string of the present invention is then pulled out of the hole. Clearly any lesser combination of the above tests could be performed.

All pressures will be measured by the electronic pressure gauge 10. The information will then be fed to the pressure data convening unit 8 which will convert the pressure data to a format readable at the surface. The pressure data is then transmitted up the wireline 4 to the surface for evaluation. Presumably, the pressure data could be transmitted directly to the surface and then convened at the surface; however, this embodiment is not preferred. All pressure measurements are preferably taken and transmitted at real time; however, some storage of data downhole may occur. To enhance real time data collection, the wireline is preferably a multiple-wire wireline.

While performing the pressure tests, downhole pressure data, and possibly other data, is transmitted up the wireline after it is convened by a pressure data convening unit. At the surface the data is gathered, and standard methods can be used to perform evaluations to determine reservoir characteristics such as permeability, extent/size of the reservoir, structural configuration of the reservoir, pressure of the reservoir, extent of near wellbore damage, etc. Those determined reservoir characteristics may then be used to evaluate the well to determine if it is a stimulation candidate, i.e. is the well damaged in a way that would benefit from such a treatment, and will the resulting production be enough to justify the expense of a stimulation treatment. As will be apparent to those skilled in the art, the accurate pressure data gathered using the present invention may be useful for other purposes as well. One advantage of the present invention is the fact that because all pressures are measured proximate the packer, or close to the perforations, well bore storage will have little effect on the final analysis. This dramatically reduces the time necessary to evaluate the pressure data received.

Figure 3:
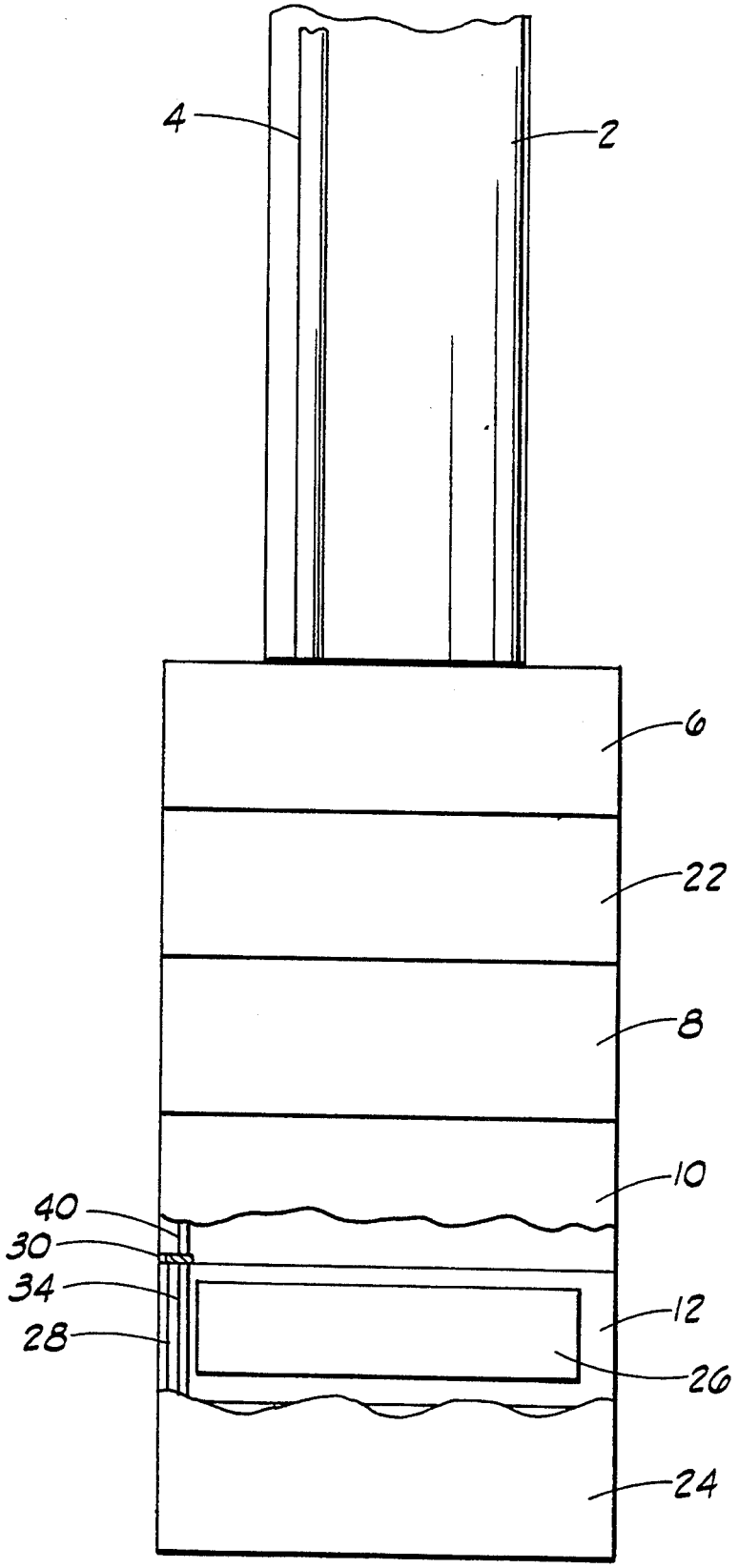
FIG. 3 is a schematic representation of a preferred embodiment of an exemplary tool string in accordance with the present invention.

FIG. 3 shows an alternative embodiment of a tool string in accordance with the present invention which contains all elements of the tool string of FIG. 1, and an additional data collection device 22, which could be a gamma ray collar locator, temperature gauge, etc. To include any additional data collecting devices 22, the wireline 4 is preferably a multiple-wire wireline to allow free flow of real time data to the surface.

In addition the preferred embodiment of FIG. 3 also includes a flow rate measurement unit or spinner 24, which can be used to collect data to correct for wellbore storage when performing pressure build-up tests. One such flow rate measurement unit is a spinner flowmeter, as is well-known in the art. Once again, many flow rate measurement tools are available. The flow rate measurement tool provides a mechanism to force fluid flow in the wellbore through a measuring device in the tool. As such, the tool can calculate the volume of fluid flowing into the wellbore from the formation. The fluid is flowing into the well due to fluid compression, because of gas, in the wellbore.

In addition, the shut-in tool 12 of FIG. 3 is modified as discussed above to provide an electrical connection to the flow rate meter 24 below the shut-in tool 12 to electrically connect the flow rate meter 24 to the wireline 4 above. In FIG. 3, a partial internal view is shown to demonstrate how the modification of the shut-in tool 12 can be accomplished. A hole 28 is bored through the body of the shut-in tool 12 which surrounds the valve means 26 of the shut-in tool. An electrical conduit 34 is then run from the flow rate meter 24 up through the hole 28 and ends at the electrical connection 30. The electrical conduit 34 is then pressure sealed into the hole 28 using standard procedures. The tool string is electrically connected to the electrical connection 30 through the electrical conduit 40 which is in electrical connection with the wireline 4.

We claim:

1. An apparatus for measuring downhole pressures during both flowing and shut-in conditions comprising:

a length of coiled tubing;

a length of wireline extending inside said coiled tubing;

a pressure data converting unit operably coupled to said coiled tubing and to said wireline;

an electronic pressure gauge operably coupled to said coiled tubing and to said wireline; and a shut-in tool coupled to said coiled tubing and capable of allowing pressure readings both during shut-in and flowing conditions.

2. The apparatus of claim 1 wherein said wireline is a multiple-wire wireline.

3. The apparatus of claim 2 further comprising an additional data collection tool operably coupled to said coiled tubing and to said wireline.

4. The apparatus of claim 3 wherein said additional data collection tool comprises a temperature gauge.

5. An apparatus for measuring downhole pressures during both flowing and shut-in conditions comprising:

(a) a coiled tubing assembly including a length of wireline extending inside a length of coiled tubing;

(b) an electronic pressure gauge operably coupled to said coiled tubing assembly and to said wireline; and (c) a shut-in tool capable of allowing pressure readings both during shut-in and flowing conditions operably coupled to said coiled tubing assembly and operable to control the flow of fluid therethrough.

6. The apparatus of claim 5 wherein said wireline is a multiple-wire wireline.

7. The apparatus of claim 5 wherein said wireline is a monoconductor wireline.

8. The apparatus of claim 5 further comprising a flow rate measuring unit operably coupled to said coiled tubing and to said wireline.

9. The apparatus of claim 1 wherein said wireline is a monoconductor wireline.

10. The apparatus of claim 1 further comprising a flow rate measuring unit operably coupled to said coiled tubing and to said wireline.

11. An apparatus for measuring downhole pressure during both flowing and shut-in condition comprising:

(a) coiled tubing having wireline extending inside and coiled tubing;

(b) a coiled tubing end connector coupled to said coiled tubing;

(c) a pressure data converting unit operably coupled to said coiled tubing and to said wireline;

(d) an electronic pressure gauge operably coupled to said coiled tubing and to said wireline;

(e) a shut-in tool capable of allowing pressure readings both during shut-in and flowing conditions operably coupled to said coiled tubing and operable to control the flow of fluid therethrough; and (f) a flow rate measuring unit operably coupled to said coiled tubing and to said wireline.

12. A method of measuring downhole pressures during both flowing and shut-in conditions in a well comprising:

providing a length of coiled tubing having wireline extending inside said coiled tubing;

providing an electronic pressure gauge operably coupled to said coiled tubing and said wireline;

providing a shut-in tool capable of allowing pressure readings both during shut-in and flowing conditions, operably coupled to said coiled tubing and operable to control the flow of fluid therethrough;

disposing said coiled tubing into said well;

seating said shut-in tool in a nipple providing in said well proximate the producing formation;

operating said shut-in tool so as to control the flow of fluid therethrough.

taking pressure readings with said electronic pressure gauge for both shut-in and flowing conditions; and transmitting said pressure readings through said wireline to the surface for use in evaluating said well.

13. The method of claim 12 further comprising using said pressure readings to determine reservoir characteristics.

14. The method of claim 13 further comprising using said determined reservoir characteristics to evaluate whether said well is a candidate for a stimulation treatment.

15. The method of claim 13 further comprising:

providing a flow rate measuring unit operably coupled to said coiled tubing and to said wireline;

using said measuring unit to measure reservoir inflow during shut-in periods; and using said reservoir inflow measurement to correct for the wellbore storage factor when determining said reservoir characteristics.

* * * * *